US009101164B2

(12) United States Patent
Schmekel et al.

(10) Patent No.: US 9,101,164 B2
(45) Date of Patent: Aug. 11, 2015

(54) EXTRACTIVE TOBACCO MATERIAL EXTRUSION

(71) Applicant: BRITISH AMERICAN TOBACCO (GERMANY) GMBH, Hamburg (DE)

(72) Inventors: Gerald Schmekel, Koelin-Reisiek (DE); Dietmar Franke, Bayreuth (DE)

(73) Assignee: British American Tobacco (Germany) GmbH, Hamburg (DE)

( * ) Notice: Subject to any disclaimer, the term of this patent is extended or adjusted under 35 U.S.C. 154(b) by 0 days.

(21) Appl. No.: 14/550,886

(22) Filed: Nov. 21, 2014

(65) Prior Publication Data

US 2015/0136151 A1 May 21, 2015

Related U.S. Application Data

(62) Division of application No. 13/125,747, filed as application No. PCT/EP2009/062365 on Sep. 24, 2009, now Pat. No. 8,931,491.

(30) Foreign Application Priority Data

Oct. 22, 2008 (DE) ..... 10 2008 052 720

(51) Int. Cl.
*A24B 15/24* (2006.01)
*C11B 1/10* (2006.01)
*A24B 1/10* (2006.01)

(52) U.S. Cl.
CPC . *A24B 15/24* (2013.01); *A24B 1/10* (2013.01); *C11B 1/102* (2013.01)

(58) Field of Classification Search
None
See application file for complete search history.

(56) References Cited

U.S. PATENT DOCUMENTS 3,046,997 A 7/1962 Hind
4,024,168 A * 5/1977 Homann et al. ..... 554/22
4,244,381 A 1/1981 Lendvay
4,887,618 A 12/1989 Bernasek et al.

(Continued)

FOREIGN PATENT DOCUMENTS

DE 2931313 A1 2/1980
DE 19535587 A1 3/1997

(Continued)

OTHER PUBLICATIONS

Examination Report, dated Dec. 27, 2012 for Canadian Application No. 2,733,716, filed Sep. 24, 2009.
Examination Report, dated Sep. 14, 2012 for Russian Patent Application No. 2011120044, filed Sep. 24, 2009.
Examination Report, dated Jan. 18, 2013, for Uzbek Application No. IAP 2011 0209, filed Sep. 24, 2009.

(Continued)

*Primary Examiner* — Michael J Felton
(74) *Attorney, Agent, or Firm* — N W Poulsen; L A Pinol

(57) ABSTRACT

The invention relates to a method for extracting agents from a tobacco material, wherein the tobacco material is conveyed through a housing to which an extraction agent is fed and from which the extraction agent is again discharge, wherein the extraction occurs in an extruder under increased extrusion pressure by way of contacting the tobacco material with the extraction agent during a tobacco material extrusion process. The invention further relates to an extraction device for tobacco material, having a housing and a conveyor unit in the housing, and having an extraction agent inlet and an extract outlet, wherein the housing is associated with a screw extruder, wherein the extract is separated from the extruder to the outside environment by means of the pressure generated therein across the drop of pressure.

19 Claims, 9 Drawing Sheets

(56) References Cited

U.S. PATENT DOCUMENTS

Figure 1:
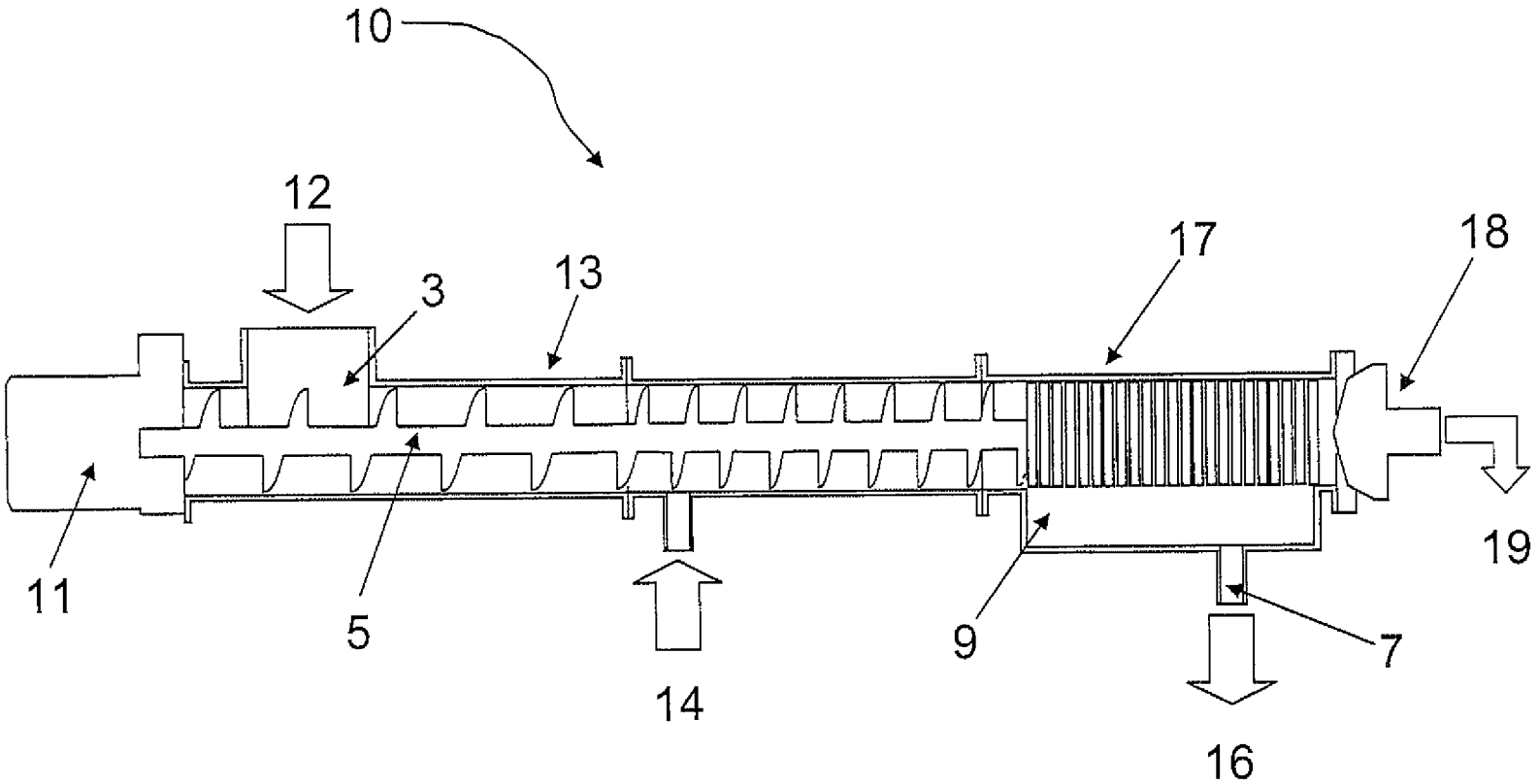

| | | | |
|---|---|---|---|
| 5,791,353 | A | 8/1998 | Jünemann et al. |
| 6,733,263 | B2 | 5/2004 | Pope et al. |
| 2004/0142081 | A1 | 7/2004 | Durand et al. |

FOREIGN PATENT DOCUMENTS

| | | | |
|---|---|---|---|
| DE | 102004059388 | A1 | 6/2006 |
| DE | 102004059388 | B4 | 11/2006 |
| EP | 0325476 | A2 | 7/1989 |
| EP | 0404473 | | 12/1990 |
| EP | 0404473 | A2 | 12/1990 |
| RU | 2304417 | C1 | 8/2007 |
| WO | 2006061117 | A1 | 6/2006 |
| WO | 2008067859 | A1 | 6/2008 |

OTHER PUBLICATIONS

Examination Report No. 1, dated May 9, 2012, for corresponding Australian Patent Application No. 2009306640, filed Sep. 24, 2009.

Notice of Acceptance, dated Aug. 21, 2012, for corresponding Australian Patent Application No. 2009306640, filed Sep. 24, 2009.

European Search Report dated Jul. 23, 2014 for EP Divisional Application 14150350.8, citing EP0404475A2 and US5791353, with Machine Translation into English.

International Search Report and Written Opinion corresponding to PCT/EP2009/062365, mailed Apr. 27, 2010 and English translation with Verification of Translation.

Notice of Acceptance issued by the Australian Patent Office on Aug. 21, 2012 for Australian Patent Application No. 2009306640.

* cited by examiner

EXTRACTIVE TOBACCO MATERIAL EXTRUSION

This application is a Divisional of U.S. patent application Ser. No. 13/125,747, filed Sep. 15, 2011, which is the U.S. National Stage Entry of PCT Application No. PCT/EP2009/062365, filed Sep. 24, 2009, which in turn claims priority to German Patent Application Number DE 10 2008 052 720.3, filed Oct. 22, 2008 The entire contents of the aforementioned applications are herein expressly incorporated by reference.

The invention resides within the technical field of extracting substances from tobacco material, as for example in so-called nitrate extraction. Depleting tobacco constituents from tobacco material, in particular from a stem material, has been described in DE 195 35 587 A1, wherein a cylindrical housing comprising a conveying screw is used for this purpose. The housing is arranged in an oblique position, and water which has been introduced collects in the region of the lower tobacco material inlet end, whereby the introduced tobacco stems are depleted of nitrate. A relative compression of the material does not occur in this housing; the increase in pressure is moderate. As a whole, a treatment in accordance with this prior art is disadvantageous alone due to the fact that a separate depletion device is required at all, and the associated equipment costs and operating costs.

DE 10 2004 059 388 84 discloses a method and device in which a tobacco stem material is comminuted by means of an extruder.

It is the object of the invention to optimise the extraction of tobacco constituents from a tobacco material. In particular, the intention is to achieve a high degree of extraction and/or to reduce the equipment costs and the operating costs.

This object is solved in accordance with the invention by a method in accordance with claim 1 and a device in accordance with claim 9. The sub-claims define preferred embodiments of the invention.

In principle, the present invention has the features of using a housing, conveying through the housing, and an extraction agent in common with the prior art; however, in accordance with the invention, extraction is characterised by contacting the tobacco material with the extraction agent during a tobacco material extrusion process in an extruder at an increased extrusion pressure. Where "extrusion" and "extruder" are mentioned, this is understood to mean a treatment of the tobacco material in which there is high mechanical compression of the tobacco material from the inlet to the outlet (tool), wherein the tool serves to extract the tobacco and for shaping and/or structuring.

Tobacco materials which can be used for manufacturing smokable cut tobacco or other smoking products (cigarettes) include—within the framework of the present invention—all known fractions, for example lamina, stems, etc., which can be conditioned by extractive extrusion and are thereby enhanced, wherein conditioning (moistening, heating) is the treating of tobacco material with water/steam, for example for the purpose of increasing its mechanical resilience.

The present invention combines the advantages of extraction and therefore depletion of constituents with the ability of extruders to comminute, mix and condition solids and then form new structures. The high pressure prevailing in such extruders (over 3 bars of absolute pressure, in particular over 10 bars of absolute pressure, specifically also over 50 bars of absolute pressure, preferably over 100 bars of absolute pressure and up to 200 bars of absolute pressure) generates a pressure gradient towards the environment, and the invention has then recognised that this pressure gradient can be used to re-extract an added extraction agent from the housing, once the constituents have been absorbed. The high pressure and mixing in the extruder help the extraction agent to achieve a high penetration of the tobacco material, which improves extraction. In this respect, a synergetic effect results, since on the one hand, multiple process steps can be combined (extruder processes such as shaping/conditioning and extraction processes), and on the other, the extraction tasks can be better completed in an extruder.

In a preferred embodiment of the method in accordance with the invention, the increased extrusion pressure and an increased extrusion temperature are thus generated by mechanically compressing the tobacco material in the extruder, in particular using a conveying screw of a screw extruder, wherein the end pressure (the differential pressure with respect to the outside environment) and the pressure profile in the extruder are determined by the free shaping cross-section in the tool, wherein the operational pressure can be determined by configuring the design of the discharge (tool) or the screw geometry. Also, variations in the rotational speed of the screw can be used to control the magnitude of dissipation and associated heating. After shaping, for example into fibres, an end moisture content for subsequent processing is set by the combination of the addition of water and the energy yield in the extruder. This end moisture content can for example always be held around 40% using the various additions, removals and settings.

The extraction agent can be a liquid, in particular water, or a gas which is brought into an extractable state by pressure and/or temperature, in particular into a liquid and/or supercritical state. It should be noted in principle that, aside from water, any other extraction agents which are Known in accordance with the prior art can also be used (depending on the desired extraction) in the present invention.

Figure 6:
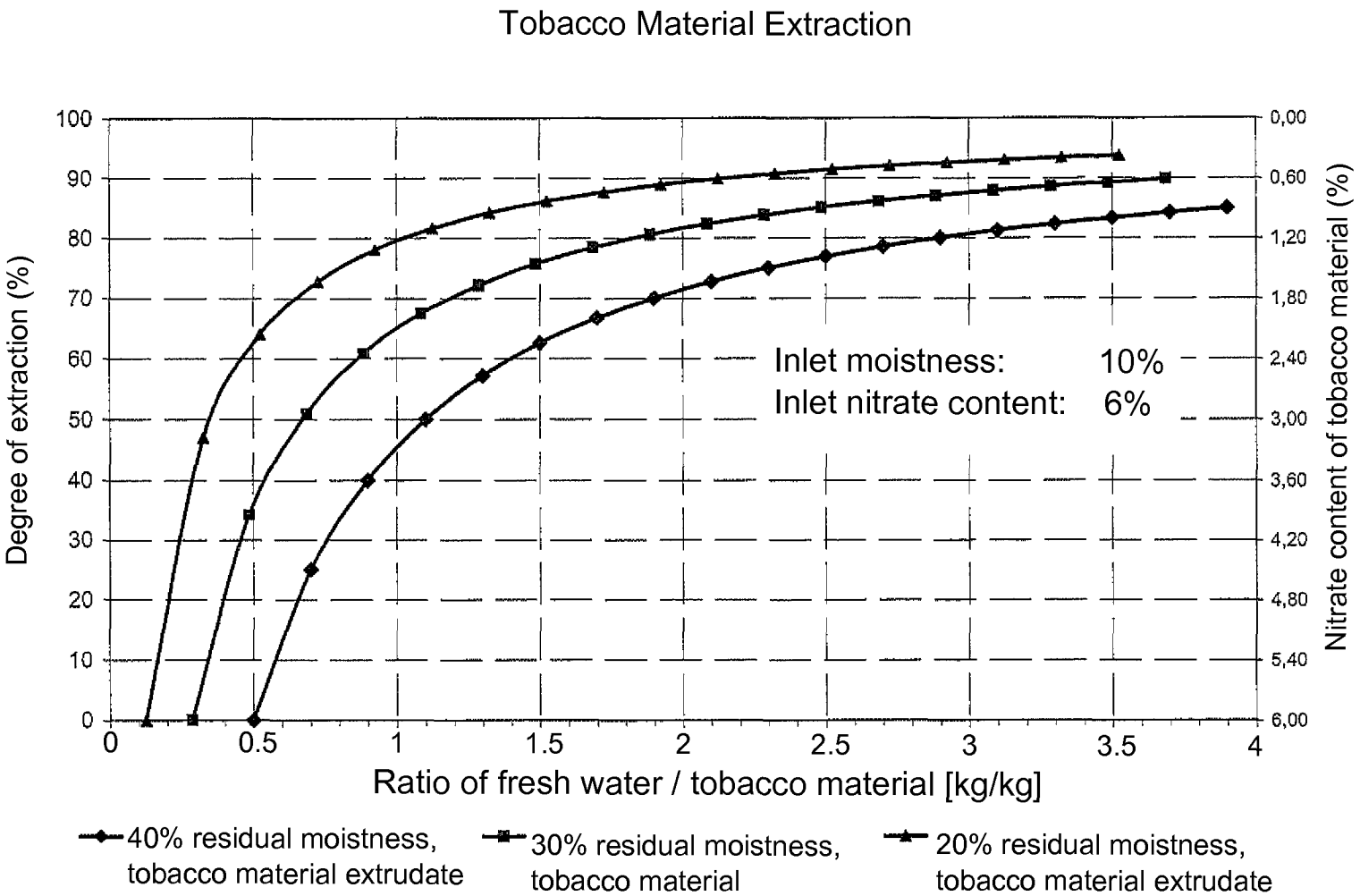

The interaction of the addition of water, the success of extraction and the output moistness achieved after leaving the extruder can be studied in FIG. 6. As can be seen, the achievable end moistness is—in addition to the ratio of fresh water to tobacco material—critical to the success of extraction. The model is based merely on a weight assessment according to the "principle of dilution". It presumes an undersaturated aqueous solution (the solubility product is not exceeded) and functions in the fresh water method, i.e. without a partial feedback of the extract phase.

Figure 7:
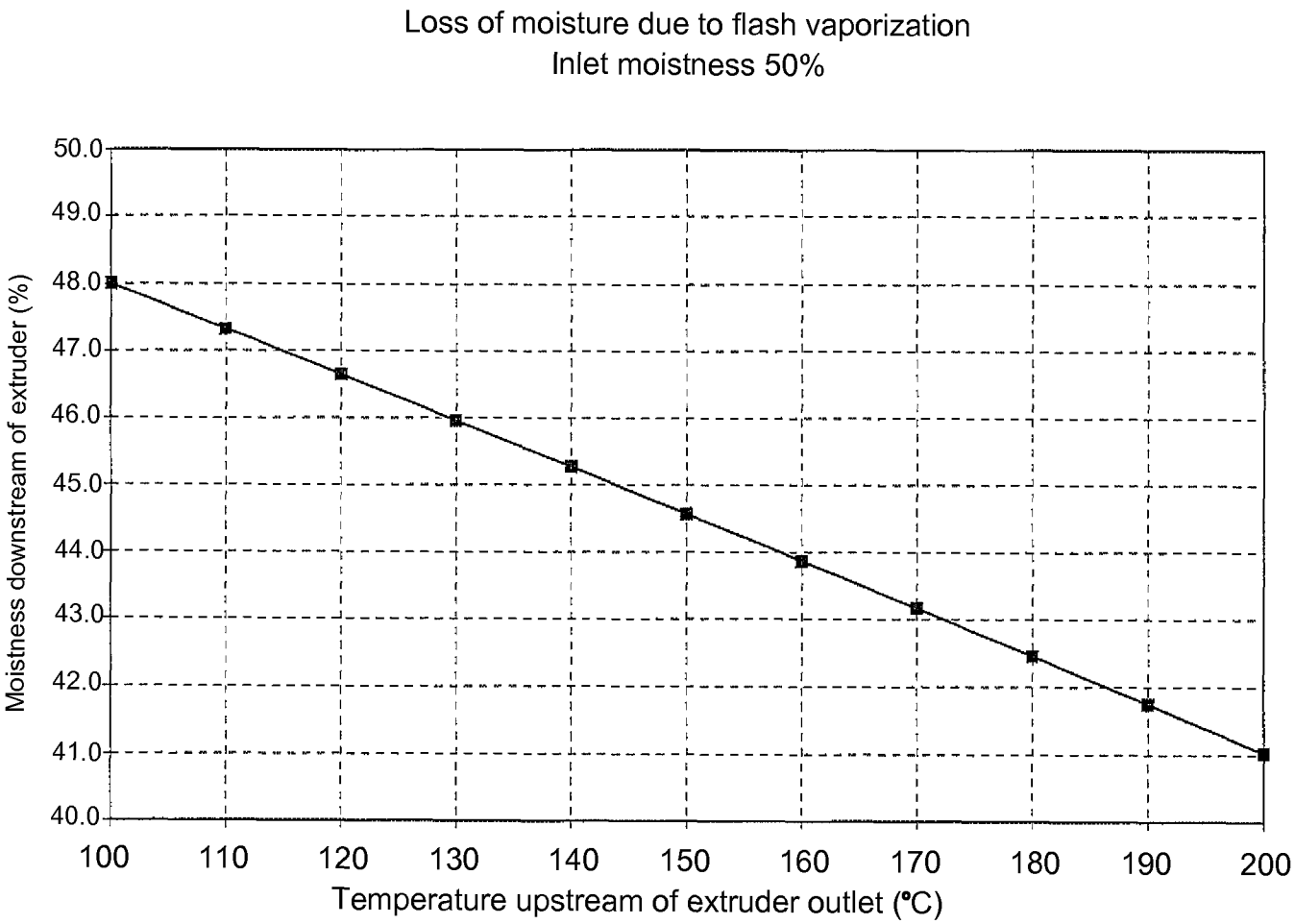

The achievable end moistness is composed of the loss of extraction agent/extract water upstream of the tool and by vaporisation downstream of the tool. Only the "mechanical loss of water" due to the extract assists depletion, while the "thermal loss of water" only affects the end temperature of the product. FIG. 7 illustrates the additional drying-out due to flash vaponsation at the outlet of the extruder.

A product generated by the processing in accordance with the invention is characterised by a depletion of soluble constituents, such as nitrate, chloride, phosphate, nicotine, proteins (depending on the pH value) etc., in the extraction agent. The undesired, so-called TSNA constituents (tobacco-specific nitrosamines) are also depleted. Interestingly, an additional filling capacity—increased by about 50%—was determined when performing the present invention, which in turn causes an advantageous reduction in the filling density in the cigarette. The increased filling capacity can only partly be explained by the loss in mass of the constituents for the same body volume. The reduced NO yield in cigarettes produced in accordance with the invention, which is correlated with the loss of nitrate and enhances the product, is of course striking.

In one embodiment in accordance with the invention, the tobacco material which is charged with the extraction agent is guided through a strainer, in particular a disc strainer, a basket strainer or a rod strainer, which separates the extract from the extruder, i.e. in this case, a strainer is used to separate the extract, and such strainers have slit apertures, in particular expanding slit apertures. They have the advantage that they do not occlude and can perform their function over a long period of time without interruptions for maintenance. Another advantageous effect is that such strainers can be relatively easily made ready for operation for the purposes of the present invention. There are for example already strainer devices for oil presses, wherein one striking difference with respect to the present invention is that the strained product rather than the extract is to be used in accordance with the invention. Another difference between a screw press comprising a strainer in accordance with the prior art (for example, an oil press) and the present invention is that such screw presses generally function without a tool or nozzle at their outlet, such that a pressure maximum occurs along the length of the path (variation in the pressure profile due to variation in the screw geometry). In extruders, the pressure increases continuously up to the outlet at the tool (restrictor). In the field of extrusion, the term "tool" is understood to mean devices for shaping doughy masses or pastes. In the simplest case, such tools are perforated metal sheets (matrices), while complicated devices also enable complex structures, including wraps, to be extruded, and enable co-extrusion. In this sense, the strainer in accordance with the present invention is used in a new technical context.

It is in principle possible to operate the extraction process in such a way that fresh water is always supplied and the extract is always drained off. However, it is of course also possible (for example, in order to save water) to completely or partially supply the extract back to the extruder as an extraction agent, wherein in particular fresh extraction agent is supplied to the extract and/or the extract is depleted of the substances to be extracted using one or more measures, for example ion exchange, reverse osmosis, pH value setting.

In one embodiment of the method in accordance with the invention, the tobacco material is subjected—before extraction—to a mechanical increase in pressure aside from extrusion, or in addition to the increase in the extrusion pressure, specifically by means of a high-pressure gear pump. The pressure can advantageously be increased after extrusion and before extraction, and it is possible to supply the extraction agent to the tobacco material before the mechanical (additional) increase in pressure. Specifically, it can be supplied at the end of the extrusion process and/or screw extruder or downstream of the extrusion process and/or screw extruder.

This mechanical increase in pressure creates a higher pressure in the extraction region, i.e. in the extraction unit of the device (for example, the strainer unit), which enables a better separation of the solid constituents from the liquid constituents. Establishing the higher pressure in the pressure increasing unit (pump) also improves the conveying characteristics in the extruder, i.e. for example in the screw extruder unit. If the extraction agent is added upstream of the pump and removed downstream of the pump, these two measures can also be decoupled with regard to their pressure ranges.

The extraction device in accordance with the invention is characterised in that the housing forms part of a screw extruder, wherein the extract is separated from the extruder by means of the pressure generated within it and via the pressure gradient towards the environment. The extruder can be a mono-screw or double-screw extruder, wherein the screw(s) generates/generate the increased extrusion pressure and an increased extrusion temperature by mechanically compressing the tobacco material. Mono-screw extruders are particularly cost-effective; double-screw extruders are more costly.

As already indicated, a strainer—in particular a disc strainer, a basket strainer or a rod strainer—can be arranged in the region of the extract outlet and separates the extract from the extruder. A collecting bath can then be arranged on the strainer, the output of which forms the extract outlet. If a feedback of extract is desired, this will be located between the extract outlet and the extraction agent inlet, and it is possible to provide a depletion device for the substances to be extracted and/or a supply line for fresh extraction agent. At the extruder outlet, the extruder can comprise a distance-variable tool using which the extruder mass flow can be set, and/or a rotational speed regulator for the screw(s), using which the pressing power in the extruder can be set. The desired shaping of the tobacco material is set by the choice of tool. The extraction agent inlet will advantageously be situated in a region of the extruder housing which lies between the tobacco material inlet and substantially the middle of the housing; in particular, it can be situated in the vicinity of the material inlet. If the housing is constructed from individual, connectable and separable sections or "stages", one of the stages can accommodate the aforementioned strainer, and the extraction agent outlet will be situated in the stage in which the extract outlet, and/or strainer is also arranged. The extraction agent inlet can in turn be situated in the vicinity of the tobacco material inlet, in particular in the same stage or in the following stage.

In very general terms, it may be said that in accordance with the invention, devices which allow the pressure gradient towards the environment to be used for squeezing out for example added water (extraction agent) in an extruder (for example, a mono-shaft pin extruder) are introduced in the region of the "compression path" of an extruder (end of the inlet zone up to the tool). In accordance with the invention, discharging the extraction agent (strainer) enables mechanical depletion during extrusion, which additionally allows degrees of freedom in the process which exceed the prior art. For example, the addition of water/steam determines the extraction temperature, since the addition of moisture has a bearing on viscosity.

The strainer devices are preferably associated with different screw configurations in an extruder, i.e. with a corresponding, optimised screw. The configuration of the surface characteristics must take into account the fact that the frictional forces between the extraction device (strainer) and the material to be pressed are higher than those between the pressed cake and the screw. The extent to which the material to be pressed rotates along with the screw is therefore reduced. If the worst comes to the worst, a "slip" on the screw reduces or prevents conveying.

One embodiment of a device in accordance with the invention comprises a mechanical pressure increasing unit for the tobacco material, which is arranged upstream of the extraction unit and in particular downstream of the extrusion unit, wherein the extrusion unit is substantially, by way of example, the screw extruder without the extrusion tool, while the extraction unit consists of the part of the device which for example includes the strainer device and is then followed by the tool. In such a configuration, it is possible to embody the mechanical pressure increasing unit as a high-pressure pump, specifically as a gear pump. It is also in particular possible to arrange the extraction agent inlet at the end of or downstream of the extrusion unit. The advantages of the embodiment of the device mentioned here have already been discussed above in the description of the corresponding method steps.

Figure 2:
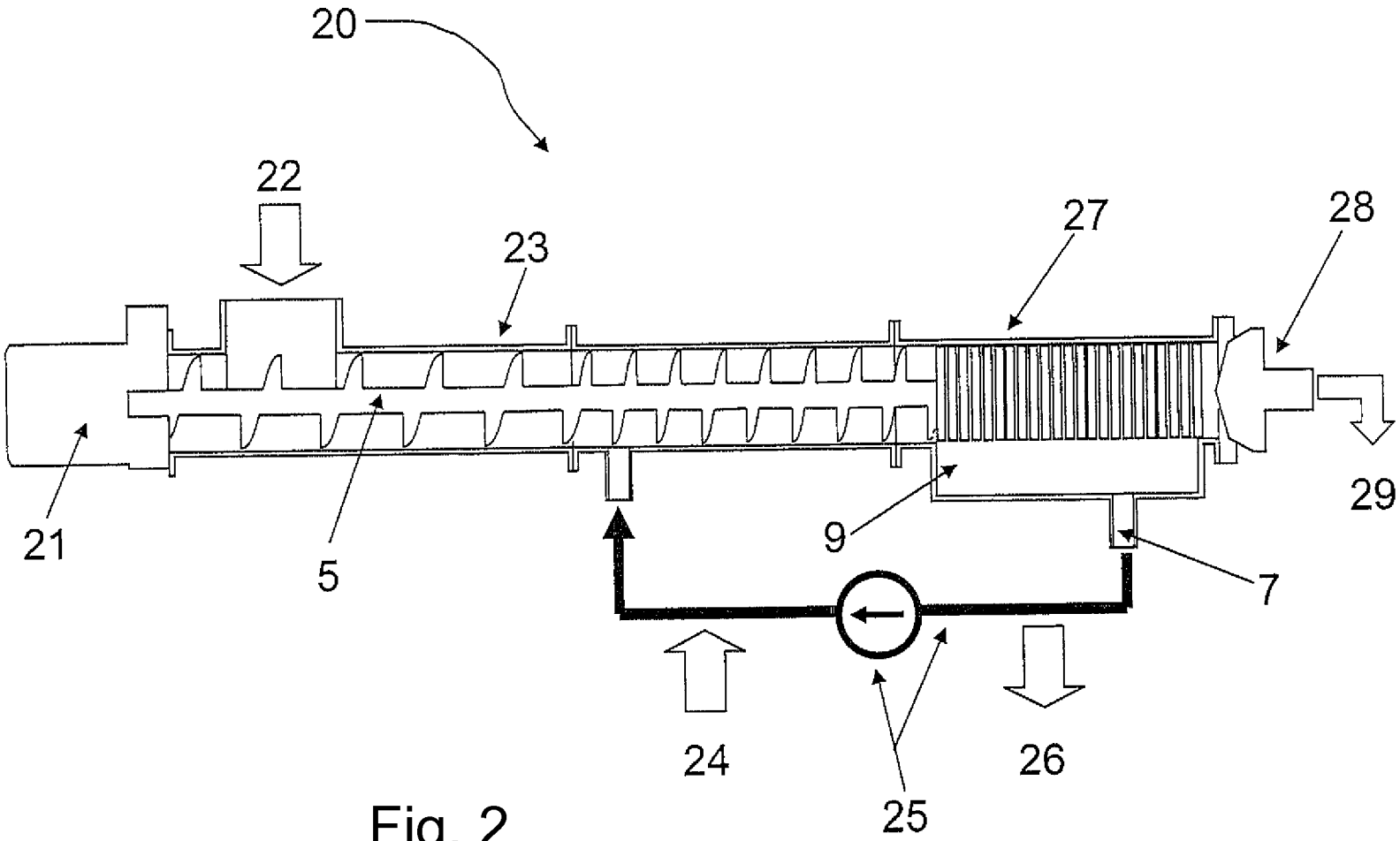
Figure 3:
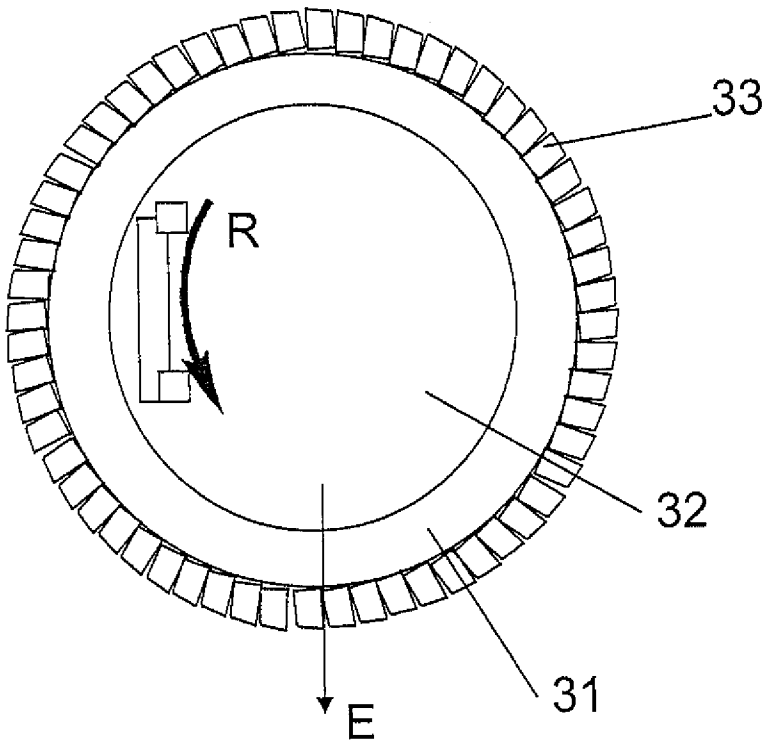
Figure 4:
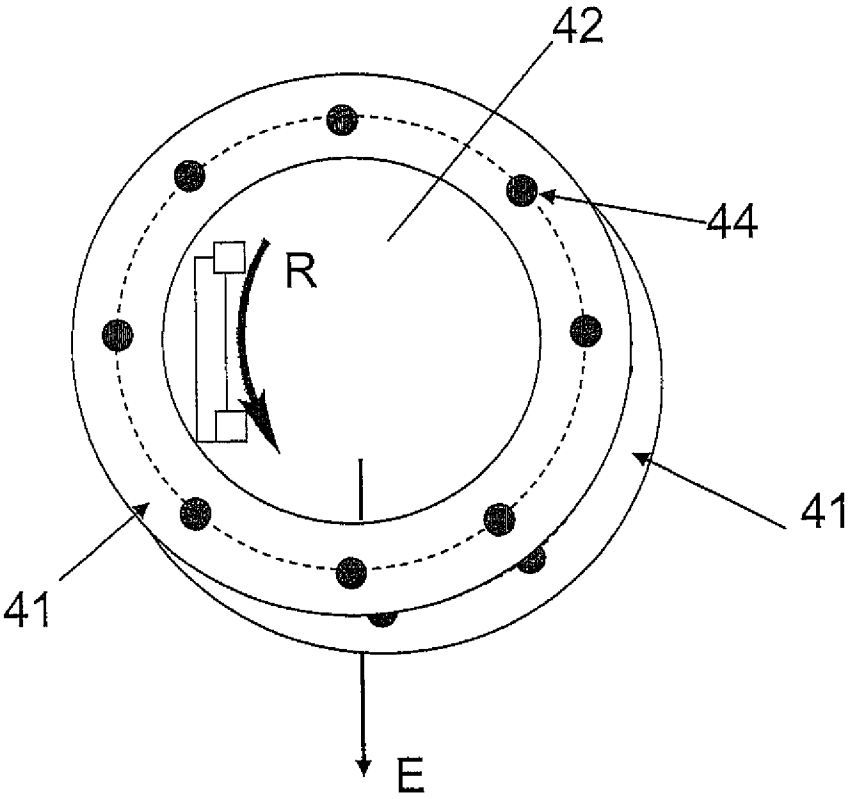
Figure 5:
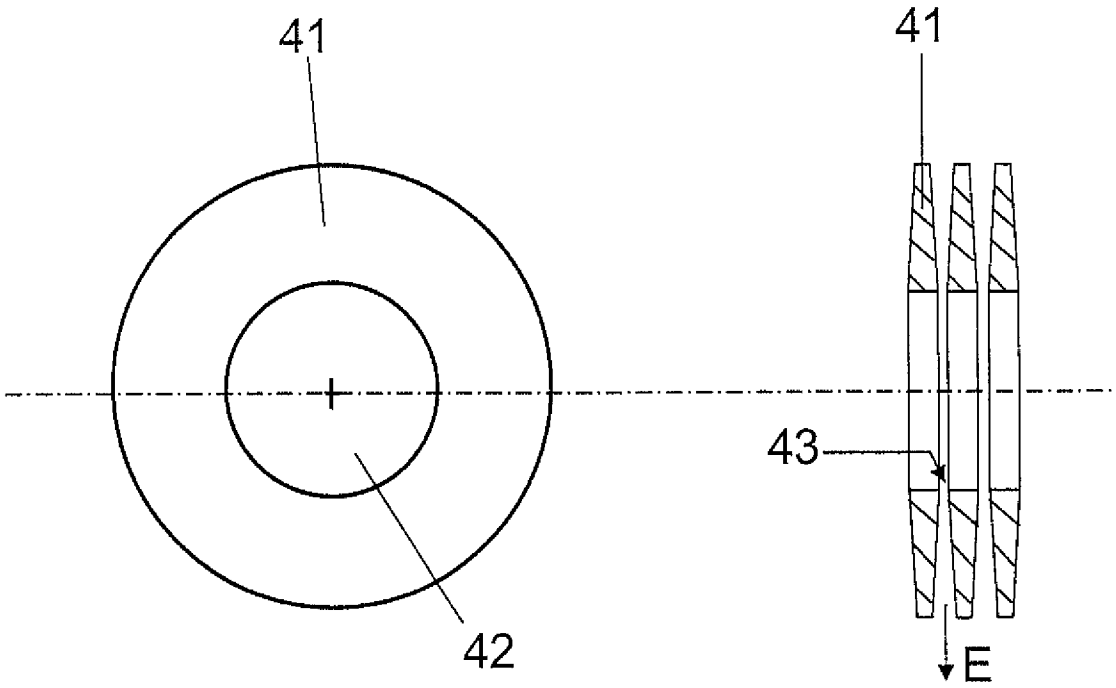
Figure 8:
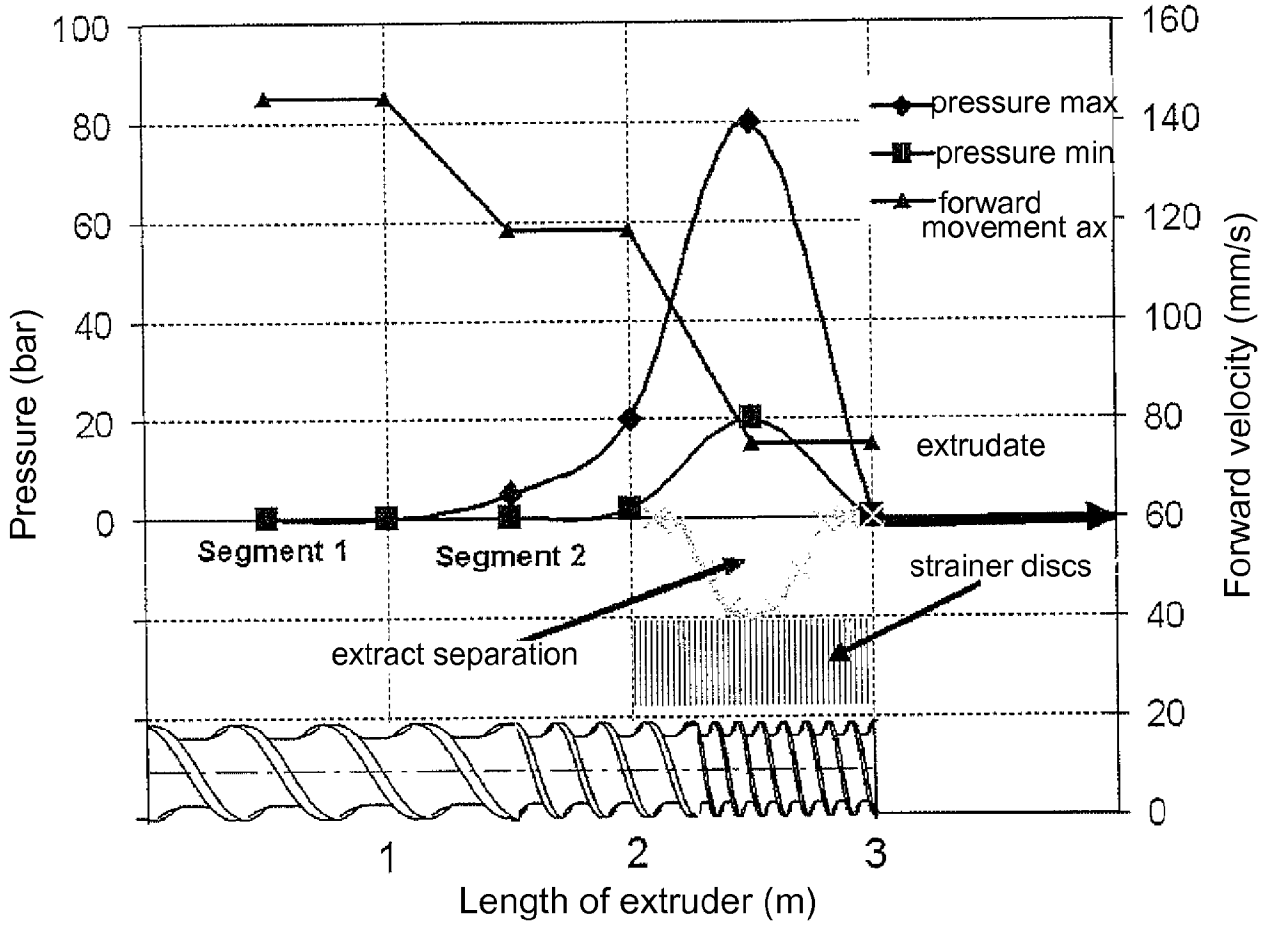
Figure 9:
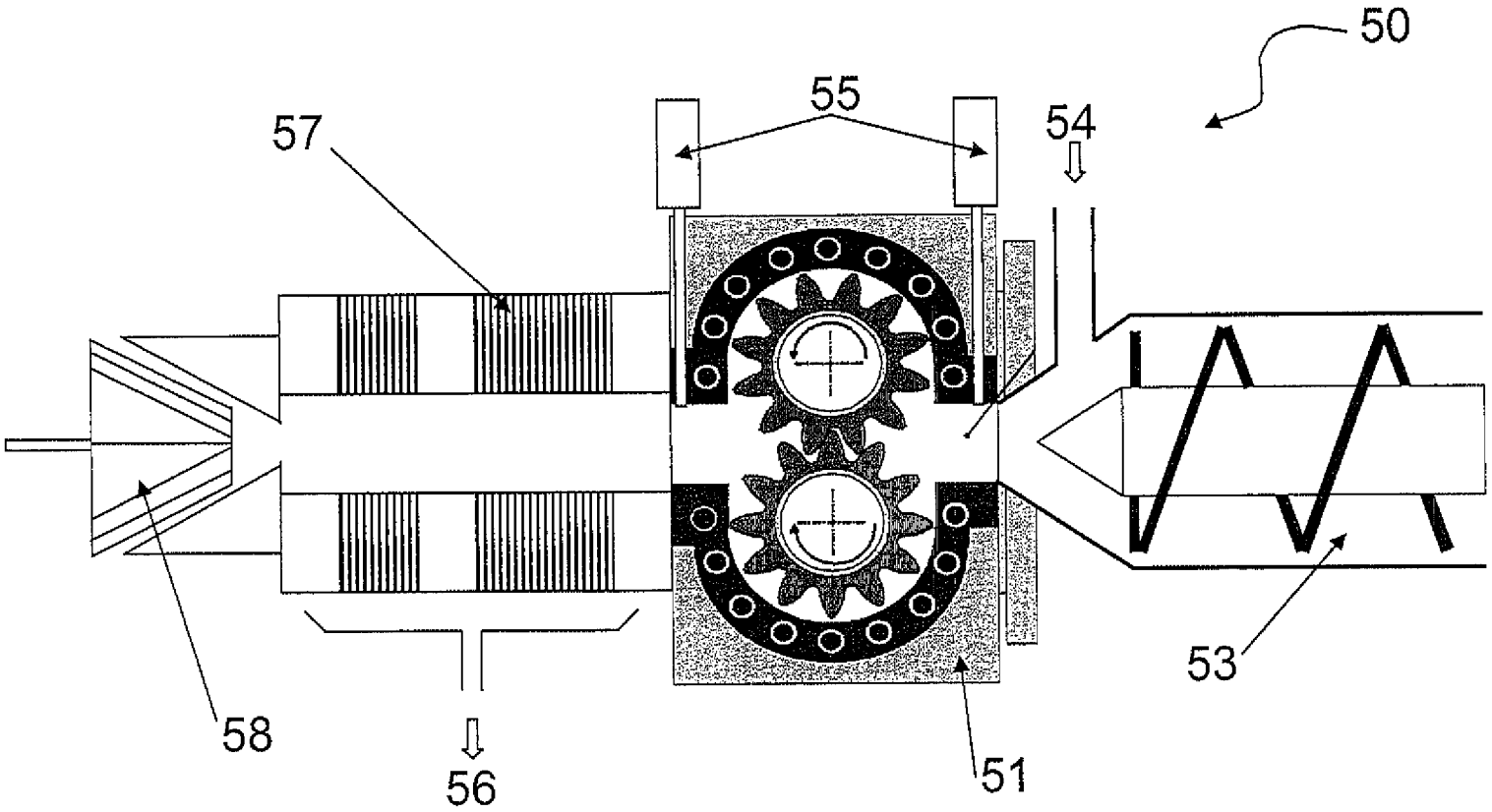

The invention is illustrated below in more detail on the basis of example embodiments and by referring to the enclosed drawings. It can include any of the features described here, individually and in any expedient combination. The enclosed drawings show:

FIG. 1 a device in accordance with the present invention as a schematic, comprising the supply of fresh water and draining-off of extract;

FIG. 2 a device in accordance with the present invention, comprising the feedback of extract;

FIG. 3 a cross-section through a housing stage of a device in accordance with the invention, comprising a rod strainer;

FIGS. 4 and 5 schematic drawings for embodiments comprising a disc strainer;

FIG. 6 a diagram of tobacco material extraction against nitrate content and proportion of fresh water;

FIG. 7 a graphic representation of the loss of moisture due to flash vaporisation at an extruder outlet;

FIG. 8 a process graph showing pressure and forward velocity over the length of the extruder; and FIG. 9 a device in accordance with the invention, comprising an additional high-pressure pump.

FIGS. 1 and 2 each show a tobacco material extruder in accordance with the invention, comprising an extraction assembly and/or capability. In FIG. 2, identical reference signs or those which are merely increased by ten indicate elements which are identical or functionally identical to those in FIG. 1, and these reference signs are not mentioned separately. The extrusion device 10 has an extruder housing 13 containing a screw 5 and a drive and/or transmission 11 for rotating it. A stem material is for example used as the tobacco material 12 and is supplied through the inlet 3 to the extruder 10, in which it is transported to the right by the screw 5 and thereby mechanically put under high pressure. The extruder consists of individual sections which are flanged together (so-called "stages"), and the extraction agent 14 is supplied in the stage downstream of the inlet 3. The housing section which in turn follows this stage is an exchangeably integrated stage which includes the strainer device 17, wherein a disc strainer is shown in this case. The collecting bath 9 comprising the extract outlet 7 is situated below the disc strainer through which the extract is extracted using the drop in pressure towards the environment. At its right-hand end is situated the extruder outlet comprising the tool 18, from which the extrudate emerges by flash vaporisation, such that for example a fibrous tobacco material results which can be immediately supplied to the manufacture of smoking products.

In the embodiment according to FIG. 1, the receptiveness of the extraction agent (water) 14 to the constituents is achieved by always adding fresh extraction agent or water 14, while the extract 16 is drained off. The embodiment according to FIG. 2 differs from this in that a recirculation operation is performed, i.e. at least a part of the loaded extraction agent which comes out of the outlet 7 is fed back again, wherein some extract is also drained off, as shown by the arrow 26, while the conduits and conveying and/or operational devices 25 provide for the return transport. Fresh extraction agent and/or fresh water is also supplied to this cycle at 24. It is perfectly possible to restrict the addition of fresh water 24 to a minimum, if suitable depletion methods are integrated into the cycle. Process steps such as changing the temperature (influencing the solubility), using ion exchangers, reverse osmosis, etc, can potentially be used. The selectivities of the extraction medium can also be influenced, as is known in accordance with the prior art. An example of this is setting the pH value, which selectively acts with respect to the depletion of native base constituents.

FIG. 3 shows a cross-section through the housing section 31 which is provided with a rod strainer 33. In the interior of the housing section and/or strainer, i.e. in the aperture 32, the screw rotates in the direction R, and the difference in pressure generated by it allows the extract E to be extracted through the intermediate spaces between the rods.

FIGS. 4 and 5 show schematic representations for the embodiment comprising a disc strainer, wherein circular rings 41 which are arranged sequentially and held at a small distance from each other by spacers 44 are used for the strainer. The loaded extraction agent 43 in the interior aperture 42 is pressed through the small slit between the inner edges of the discs 41 by the prevailing high pressure, and separated as the extract E. The discs are designed such that they taper slightly outwards, such that the extraction slit expands outwards. The same effect is achieved with strainer rods, and this opening profile of the expanding strainer slits generates an optimum environment for the escape of extract by pressurised conveying.

The present invention is again discussed below in slightly more detail with the aid of an example. In the example embodiment, a Burley stem grade with a nitrate content of about 6% was subjected to extractive extrusion in accordance with the invention with the aid of a strainer basket consisting of strainer discs having a free clearance of 0.2 mm at their inner diameter. For this purpose, a three-stage mono-shaft extruder was used in a fresh water operation at a water flow ratio of 2 kg water/1 kg stems in accordance with FIG. 1.

The achieved end moistness varied, depending on process conditions, between 20 and 45%. The end result is influenced by the pressing power, the length of the strainer, the operating temperature and the addition of water. The screw configuration, consisting of three elements exhibiting a decreasing pitch which ensures compression along the length of the path, is shown below the process diagram in FIG. 8. The compression achieved is in equilibrium with the required pressure for a flow through the tool. Decreasing axial forward movement is the result of the reduction in chamber volume and the compression.

The extract is discharged via the strainer and collected. Depending on the tool, it was possible to achieve a defibrated stem which can be directed used, without subsequent treatment.

Alternatively, a discharge exhibiting greater moistness—suitable for direct cutting—is possible. However, the achievable degree of nitrate depletion—caused by the greater required outlet moistness for the same extraction ratio—is smaller. Depending on the local feed conditions, the extract can be supplied to the sewer system/sewage treatment plant. It is also in principle possible to treat it, and this is decided by economic considerations.

The extrudate was subjected to a standard analysis, with the following results:

| | starting material | end product | Remarks |
|---|---|---|---|
| nitrate content | 6.0% | 1.2% | corresponds approximately to the dilution model in FIG. 1 |
| chloride content | 2.8% | 0.56% | corresponds approximately to the dilution model in FIG. 1 |
| filling capacity | 3.1 ml/g | 7.0 ml/g | significant increase in filling capacity as compared to standard stem methods* |

*with respect to a filling capacity of a "standard fibre extrusion" in accordance with DE 10 2004 059 388 A1 of up to about 4-5 ml/g, or a stem treatment using a cutter with a filling capacity of 5-6 ml/g.

Cigarettes were produced from the product, and cut tobacco mixtures were provided with a 20% proportion of stems for this purpose. The sample contained stems which were manufactured using the method in accordance with the invention. The comparison was provided with stems which were only subjected to an extrusion without extraction.

The effects of stem extraction on physical data and smoking values can be summarised and described as follows.

about 20% increased resistance to draw;

about 25% less diameter deformation (better hardness for the same filling density);

about 66% reduced end mortality.

A slightly modified embodiment of a device in accordance with the invention can be seen in FIG. 9. In this case, the material flows from right to left, i.e. the tobacco material comes from the extruder unit 53 of the device 50, wherein the extraction agent is supplied at the end of the extruder unit (screw extruder) 53, as indicated by the arrow 54.

The tobacco material provided with the extraction agent then enters a high-pressure gear pump, which has retained the reference sign 51 in FIG. 9, in which the inlet pressure and the outlet pressure is monitored by two pressure sensors 55.

As it passes through the high-pressure pump 51, the pressure in the tobacco material is significantly increased mechanically. At this high pressure, the tobacco material enters the extraction unit—i.e. in this case, the strainer device 57—where the loaded extraction agent is outputted (arrow 56). The tobacco material can then be shaped by means of the tool 58.

The high-pressure pump 51, which fulfils the pressure-increasing functions for the tobacco material to be transported and processed, is thus inserted between the strainer basket 57 and the extruder 53. It should be stated here that the high-pressure pump can in principle completely assume the function of increasing the pressure or can also provide an additional increase in pressure, in addition to an increase in pressure in the extruder. In any event, if the highest pressure does not occur until downstream of the pump 51, then inputting the extraction agent at the arrow 54 at the end of the extruder becomes simpler, since it does not have to be introduced against the highest pressure in the system. Thus, in this embodiment, the pressure ranges are decoupled between the extraction agent input and the extraction agent output. It is also possible to generate a higher pressure in the strainer basket region 57, which provides for a better separation of the solid constituents from the liquid constituents. Another advantageous effect of decoupling the pressure, i.e. of having the highest pressure not until the end of the pump 51, is better conveying characteristics in the extruder.

The invention claimed is:

1. A method for extracting substances from a tobacco material, wherein the tobacco material is conveyed through a housing to which an extraction agent is supplied and from which the extraction agent is drained off again, wherein extraction is performed by contacting the tobacco material with the extraction agent during a tobacco material extrusion process in an extruder at an increased extrusion pressure and a mechanical depletion of the extraction agent occurs by discharging the extraction agent during extrusion.

2. The method according to claim 1, wherein the increased extrusion pressure and an increased extrusion temperature are generated by mechanically compressing the tobacco material in the extruder.

3. The method according to claim 1, wherein the extraction agent is brought into an extractable state by at least one of pressure and temperature.

4. The method according to claim 1, wherein the tobacco material which is charged with the extraction agent is guided through a strainer which separates an extract from the extruder.

5. The method according to claim 4, wherein the extract is supplied back to the extruder as an extraction agent, wherein fresh extraction agent is added to the extract.

6. The method according to claim 1, wherein the tobacco material is subjected—before extraction—to a mechanical increase in pressure aside from extrusion or in addition to extrusion.

7. The method according to claim 6, wherein the pressure is mechanically increased after extrusion and before extraction.

8. The method according to claim 6, wherein the extraction agent is supplied to the tobacco material before the mechanical increase in pressure.

9. The method according to claim 1, wherein the increased extrusion pressure and an increased extrusion temperature are generated by mechanically compressing the tobacco material using a conveying screw of a screw extruder.

10. The method of claim 3, wherein the extractable state of the extraction agent is liquid.

11. The method of claim 3, wherein the extractable state of the extraction agent is a supercritical state.

12. The method of claim 3, wherein the extraction agent is liquid.

13. The method of claim 12, wherein the liquid is water.

14. The method of claim 3, wherein the extraction agent is gas.

15. The method of claim 4, wherein the strainer is at least one of a disc strainer, a basket strainer and a rod strainer.

16. The method according to claim 4, wherein the extract is supplied back to the extruder as an extraction agent, wherein the extract is depleted of substances to be extracted using at least one of: ion exchange, reverse osmosis and pH value setting.

17. The method of claim 6, wherein the mechanical increase in pressure is achieved using a high-pressure gear pump.

18. The method of claim 6 wherein the extraction agent is supplied to the tobacco material downstream of an extrusion process.

19. The method of claim 6 wherein the extraction agent is supplied to the tobacco material downstream of a screw extruder.

* * * * *